US010316597B2

(12) United States Patent
Rios

(10) Patent No.: US 10,316,597 B2
(45) Date of Patent: Jun. 11, 2019

(54) TUBULAR CLAMP SYSTEM

(71) Applicant: FORUM US, INC., Houston, TX (US)

(72) Inventor: Rogelio Rios, Spring, TX (US)

(73) Assignee: FORUM US, INC., Houston, TX (US)

( * ) Notice: Subject to any disclaimer, the term of this patent is extended or adjusted under 35 U.S.C. 154(b) by 72 days.

(21) Appl. No.: 15/453,629

(22) Filed: Mar. 8, 2017

(65) Prior Publication Data

US 2018/0258715 A1 Sep. 13, 2018

(51) Int. Cl.
*E21B 19/06* (2006.01)
*E21B 19/16* (2006.01)

(52) U.S. Cl.
CPC ..... *E21B 19/06* (2013.01); *E21B 19/163* (2013.01)

(58) Field of Classification Search
CPC ..... E21B 19/06; E21B 19/163; E21B 19/161; E21B 19/155; E21B 19/164
See application file for complete search history.

(56) References Cited

U.S. PATENT DOCUMENTS

| | | | |
|---|---|---|---|
| 3,561,811 | A | 2/1971 | Turner, Jr. |
| 3,615,027 | A | 10/1971 | Ham |
| 3,633,767 | A | 1/1972 | Mitchell et al. |
| 3,709,379 | A | 1/1973 | Kaufeldt |
| 3,768,663 | A | 10/1973 | Turner, Jr. et al. |
| 3,901,392 | A | 8/1975 | Streckert |
| 3,976,207 | A | 8/1976 | Schultz |
| 4,013,178 | A | 3/1977 | Brown et al. |
| 4,042,123 | A | 8/1977 | Sheldon et al. |
| 4,077,525 | A | 3/1978 | Callegari et al. |
| 4,132,318 | A | 1/1979 | Wang et al. |
| 4,187,546 | A | 2/1980 | Heffernan et al. |
| 4,462,733 | A | 7/1984 | Langowski et al. |
| 4,582,133 | A | 4/1986 | Tambs |
| 4,610,315 | A | 9/1986 | Koga et al. |
| 5,198,736 | A | 3/1993 | Azuma et al. |
| 5,868,045 | A | 2/1999 | Hauk |
| 6,976,540 | B2 | 12/2005 | Berry |
| 7,246,983 | B2 | 7/2007 | Zahn et al. |
| 8,186,455 | B2 | 5/2012 | Childers et al. |
| 8,317,448 | B2 | 11/2012 | Hankins et al. |
| 9,181,764 | B2 | 11/2015 | Hu |
| 2005/0076744 | A1* | 4/2005 | Pietras ..... E21B 19/163 81/57.16 |
| 2008/0060850 | A1 | 3/2008 | Stanton et al. |
| 2009/0056961 | A1 | 3/2009 | Gharsalli et al. |
| 2009/0185883 | A1 | 7/2009 | Wright et al. |
| 2015/0107850 | A1 | 4/2015 | Mosing et al. |
| 2015/0314972 | A1 | 11/2015 | Schenning |

FOREIGN PATENT DOCUMENTS

| | | | |
|---|---|---|---|
| CA | 2640111 | A1 | 7/2009 |
| GB | 2406867 | A | 4/2005 |

OTHER PUBLICATIONS

International Search Report and Written Opinion dated May 15, 2018, corresponding to Application No. PCT/US2018/017253.

* cited by examiner

*Primary Examiner* — James G Sayre
(74) *Attorney, Agent, or Firm* — Patterson + Sheridan, LLP

(57) ABSTRACT

A tubular clamp system comprising a carriage assembly coupled to a gripper assembly. The gripper assembly includes a pair of jaws movable into engagement with a tubular by a lead screw that is rotated by a first actuator. The pair of jaws are configured to grip and lift the tubular by a thrust nut that is coupled to the lead screw and is rotatable by a second actuator.

21 Claims, 10 Drawing Sheets

TUBULAR CLAMP SYSTEM

BACKGROUND

Field

Embodiments of the disclosure relate to a tubular clamp system for handling tubulars.

Description of the Related Art

A tubular clamp system is often used in conjunction with a crane located on an oil and gas rig to handle one or more tubulars, such as to build multiple stands of tubulars. The tubular clamp system and the crane are used to make up or break out, and move the tubulars between well center and a racking board. Conventional tubular clamp systems use direct powered jaws to grip the tubulars.

However, in the event of a loss of power, these conventional tubular clamp systems will lose grip and drop any tubular that it is supporting, which can cause harm to rig personnel and/or damage surrounding equipment. Also, there is potential of slippage of the tubular from the tubular clamp system as a prime mover mechanism of the direct powered clamps begins to wear, or alternatively the potential of over clamping and crimping the tubular. Lastly, if a crane begins to lift a tubular that is still being gripped by the tubular clamp system (for example due to an operator's failure to disengage the tubular clamp system) then the tubular clamp system can be overloaded and damaged from further use.

Therefore, there exists a need for new and improved tubular clamp systems.

SUMMARY

In one embodiment, a tubular clamp system comprises a boom structure and a clamp mechanism coupled to the boom structure. The clamp mechanism comprises a carriage assembly and a gripper assembly coupled to the carriage assembly. The gripper assembly includes a pair of jaws movable into engagement with a tubular by a lead screw that is rotatable by a first actuator. The pair of jaws are configured to grip and lift the tubular by a thrust nut that is coupled to the lead screw and is rotatable by a second actuator.

In one embodiment, a clamp mechanism comprises a carriage assembly; and a gripper assembly coupled to the carriage assembly, wherein the gripper assembly includes a pair of jaws movable into engagement with a tubular by a first actuator, and wherein the pair of jaws are configured to grip and lift the tubular by a second actuator.

BRIEF DESCRIPTION OF THE DRAWINGS

To facilitate understanding, identical reference numerals have been used, where possible, to designate identical elements that are common to the figures. It is contemplated that elements disclosed in one embodiment may be beneficially utilized with other embodiments without specific recitation.

DETAILED DESCRIPTION

Embodiments of the disclosure relate to a tubular clamp system for handling tubulars on an oil and gas rig. The tubular clamp system includes a clamp mechanism having a gripper assembly and a carriage assembly. The gripper assembly includes two opposing jaws movable by lead screws. A low-torque actuator (e.g. a first actuator) will rotate the lead screws to drive the two opposing jaws into engagement with the outer perimeter of a tubular. The jaw actuator does not provide full clamp force but merely brings the jaws into contact with the outer surface of the tubular.

A torque thrust actuator (e.g. a second actuator) separate from the jaw actuator may be used to lift a lever arm that rotates a thrust nut to further drive the lead screw and the two opposing jaws into gripping engagement with the tubular. The torque thrust actuator provide a clamp force on the tubular up to a force that equals the weight of the tubular, times the mechanical advantage of the lever arm, times the wedge geometry of the lead screw. As the torque thrust actuator pushes on the torque levers beyond the rotational torque required to clamp and overcome the weight, the gripper assembly and the clamped tubular will lift off the carriage assembly and may trigger a switch that will signal positive clamp and support of the tubular being handled.

The weight of the tubular is the actuating force of the clamp mechanism while the actuators are merely supporting the live load of the tubular being lifted, and not a direct clamp force. Due to the characteristics of the lead screw, the lead screw is self-locking and will support the clamp force for as long as the tubular is being supported/handled with or without power to the clamp mechanism. The independent movement of the gripper assembly and the carriage assembly connected by the torque thrust actuator via the lever arm of the clamp mechanism allows for the external lifting of the clamped tubular that can unload the weight and reverse the force on the lever arm, auto releasing (unscrewing) the thrust nut and allowing for fail-safe release of the tubular.

Figure 1:
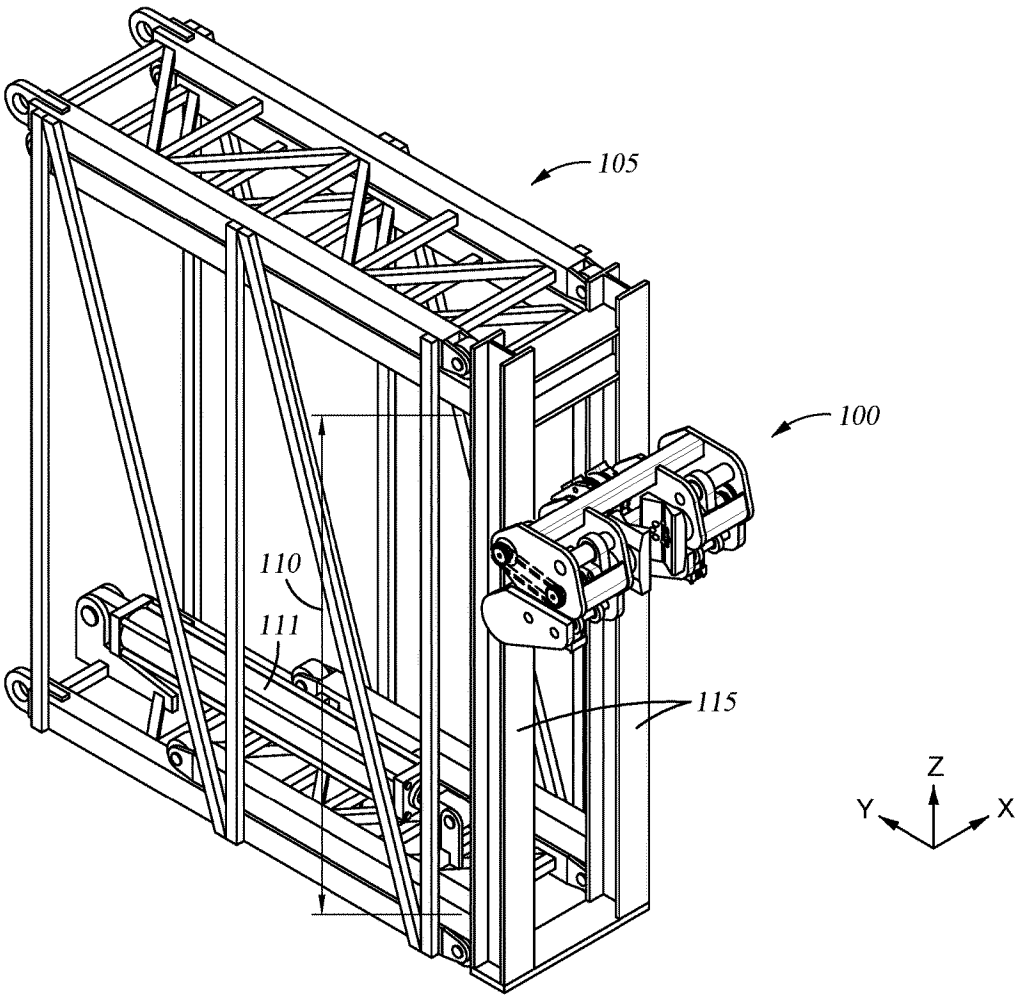
FIG. 1 is an isometric view of a tubular clamp system having a clamp mechanism according to embodiments described herein.

FIG. 1 is an isometric view of a tubular clamp system having a clamp mechanism 100 coupled to a boom structure 105. The boom structure 105 may be coupled to an oil and gas rig such that it is movable horizontally in the X-direction and/or vertically in the Z-direction. A portion of the boom structure 105 that the clamp mechanism 100 is coupled to is movable by an actuator, referred to herein as a piston/ cylinder assembly 111, to extend and retract the clamp mechanism 100 horizontally in the Y-direction. The clamp mechanism 100 is movable by another actuator, such as a piston/cylinder assembly and/or a cable/pulley assembly, to raise and lower the clamp mechanism 100 along a length 110 of a portion of vertically extending beams 115 of the boom structure 105. The portion of the boom structure 105 and/or the clamp mechanism 100 can be moved by any type of hydraulic, pneumatic, electric, and/or mechanical actuated assemblies and are not limited to movement by piston/cylinder or cable/pulley assemblies.

In operation, the clamp mechanism 100 is configured to grip, raise, and lower a tubular relative to the boom structure 105. For example, a portion of the boom structure 105 may be extended by the piston/cylinder assembly 111 to grip a tubular with the clamp mechanism 100 and then retracted back. The clamp mechanism 100 may then be lifted up along the length 110 of the beams 115 to lift the tubular vertically. Lastly, the boom structure 105 with the clamp mechanism 100 gripping the tubular may be moved laterally to position the tubular in a pipe deck or a racking board.

Figure 2:
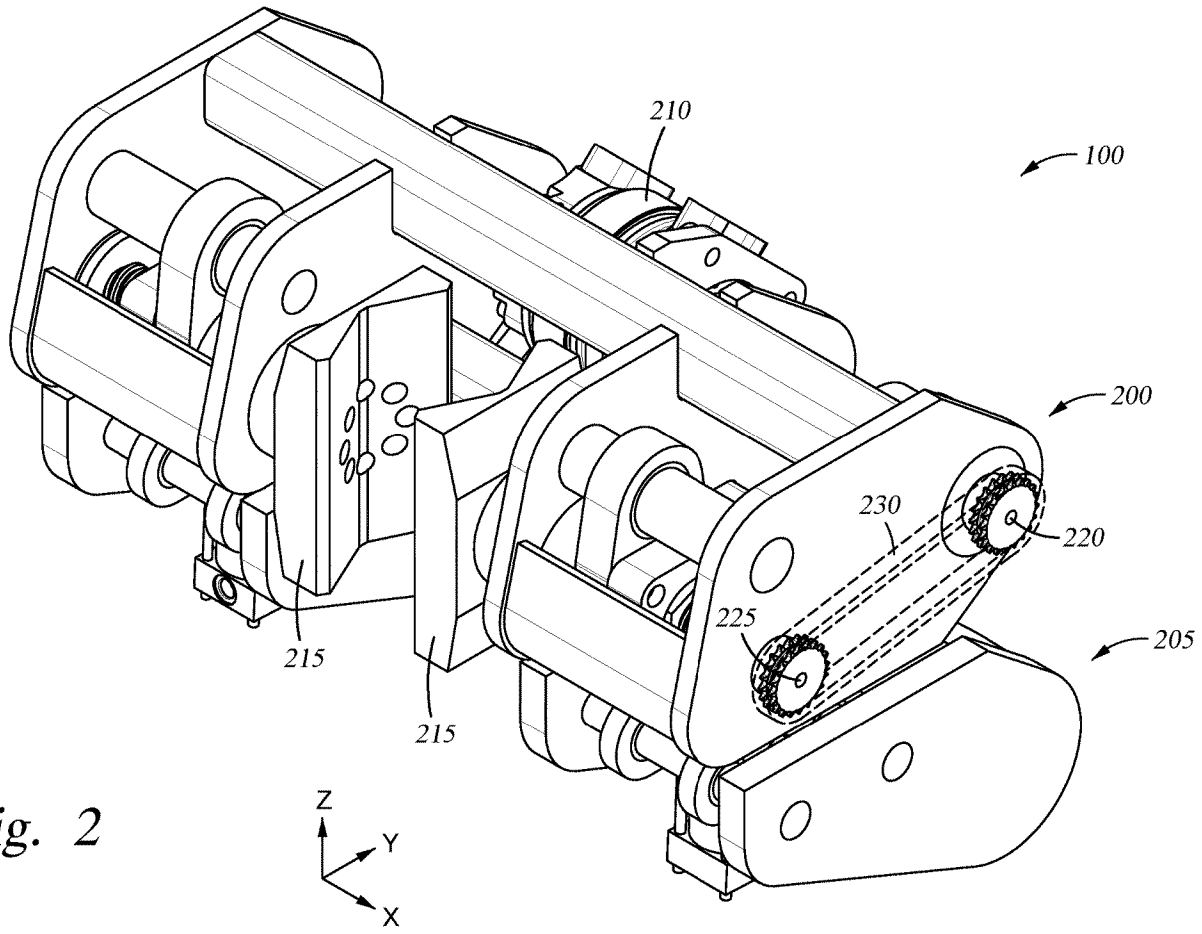
FIG. 2 is an isometric front view of the clamp mechanism of FIG. 1.
Figure 3:
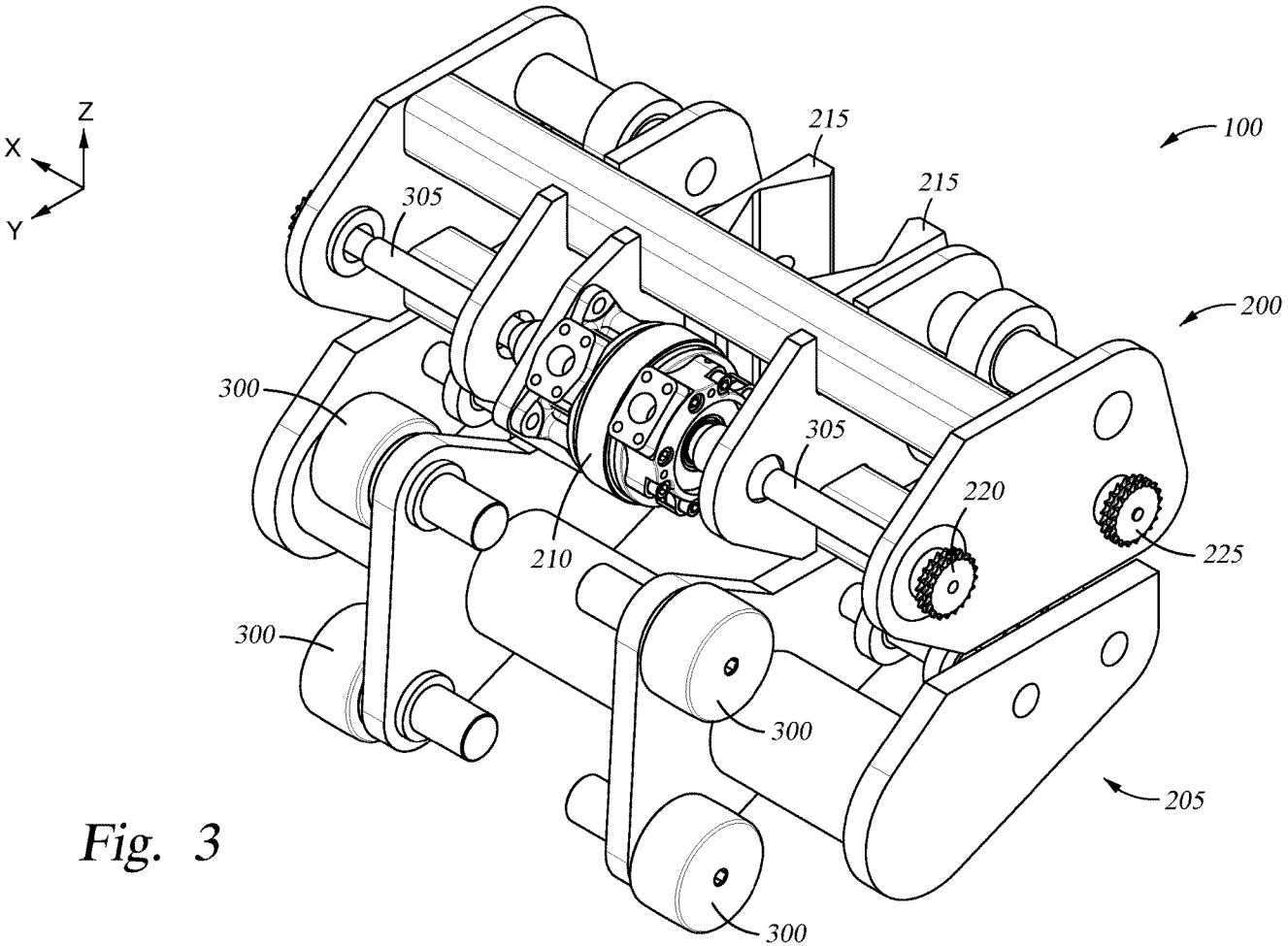
FIG. 3 is an isometric back view of the clamp mechanism of FIG. 1.
Figure 4:
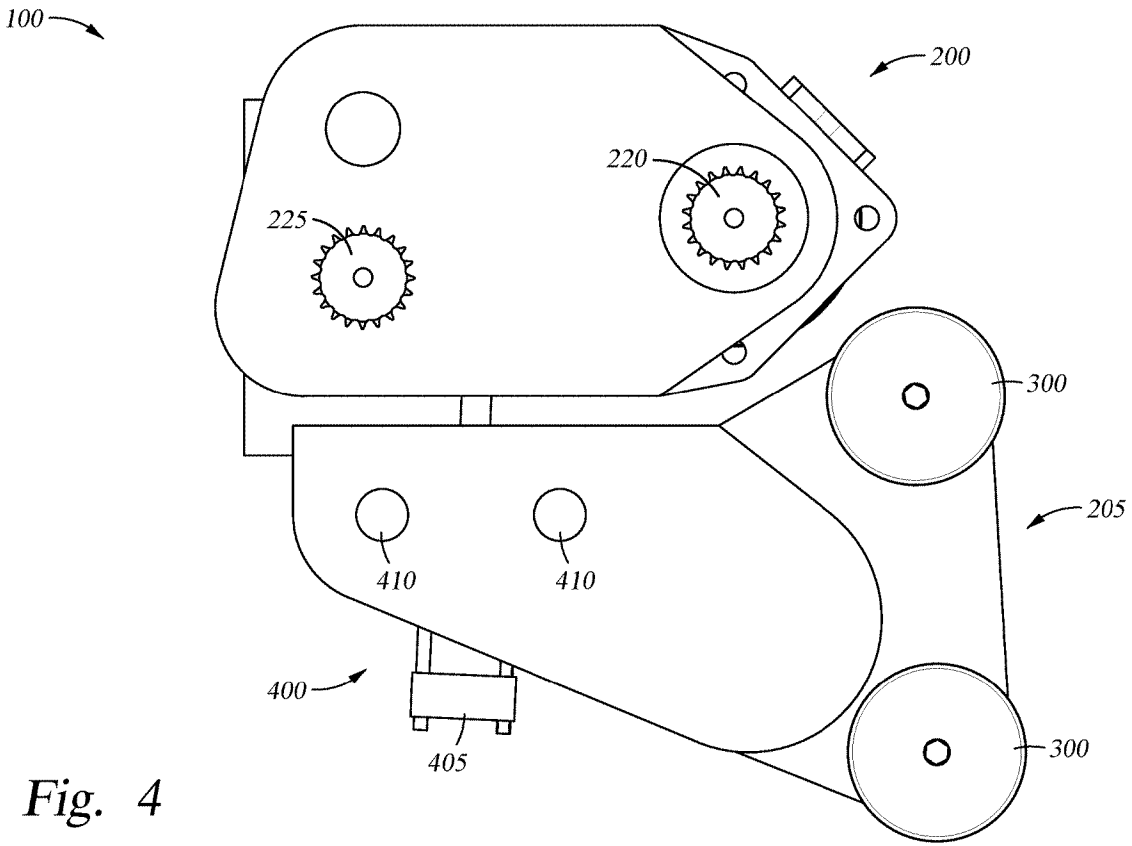
FIG. 4 is a side view of the clamp mechanism of FIG. 1.

FIG. 2-4 are various views of the clamp mechanism 100 of FIG. 1. FIG. 2 is an isometric front view of the clamp mechanism 100. FIG. 3 is an isometric back view of the clamp mechanism 100. FIG. 4 is a side view of the clamp mechanism 100.

The clamp mechanism 100 includes a first member such as a gripper assembly 200 coupled to a second member or carriage assembly 205. The carriage assembly 205 includes a plurality of rollers 300 (shown in FIG. 3) that help facilitate movement of the clamp mechanism 100 along the beams 115 of the boom structure 105 shown in FIG. 1.

The clamp mechanism 100 includes a low torque actuator 210 (e.g. a first actuator) that is operably coupled to a pair of gripper jaws 215. The actuator 210 may be coupled to one or more shafts 305 (shown in FIG. 3), and each shaft 305 may be coupled to a first sprocket 220. The first sprocket 220 is coupled to a second sprocket 225 by a flexible drive member 230 (shown in dashed lines in FIG. 2) such as a chain.

In operation, the actuator 210 rotates the one or more shafts 305 and the first sprocket 220, and the flexible drive member 230 rotates the second sprocket 225 which causes the gripper jaws 215 to move toward each other or away from each other (in the X-direction) to clamp onto a tubular or release a clamped tubular, respectively. The carriage assembly 205 and the gripper assembly 200 may be coupled together by a torque thrust assembly 400 (shown in FIG. 4) that may comprise a torque thrust actuator 405 (e.g. a second actuator), an arm 815 retractable into and extendable from the torque thrust actuator 405, and pins 410, among other support members described below.

Figure 5:
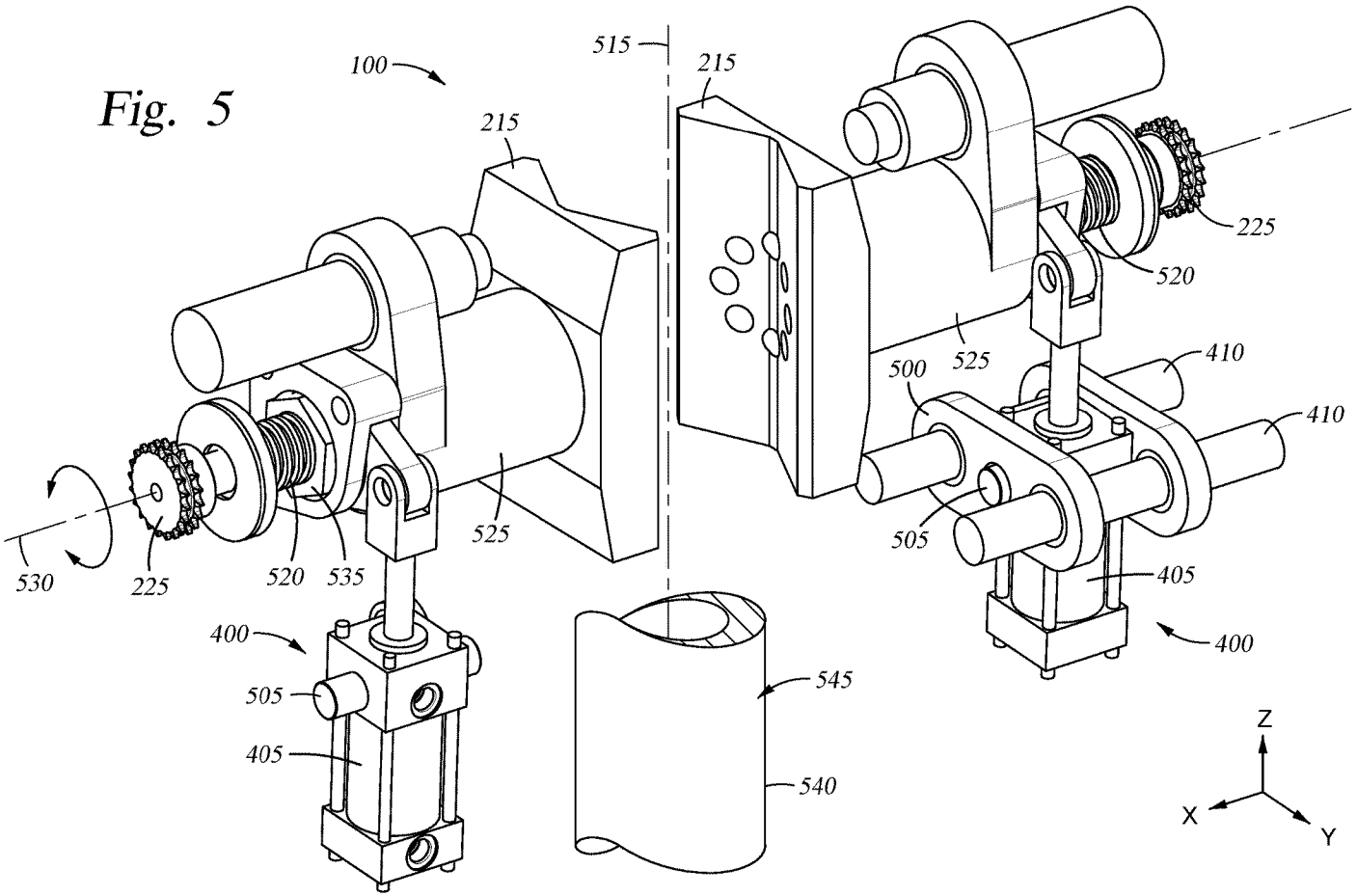
FIG. 5 is an isometric view of the gripper assembly of FIGS. 2-4.

FIG. 5 is an isometric view of the gripper assembly 200 of FIGS. 2-4. The carriage assembly 205 is not shown in FIG. 5 in order to show details of the gripper assembly 200.

The torque thrust assembly 400 includes the pins 410 coupled to support members 500. The support members 500 are coupled to a center pin 505 that is coupled to the torque thrust actuator 405. The center pin 505 may be a gimbal mechanism that provides rotation of the torque thrust actuator 405 about an axis normal to an axis 515 of the gripper assembly 200 (e.g. the axis of a tubular to be gripped). The support members 500 and pins 410 are not shown on the torque thrust assembly 400 on the left side of the torque thrust assembly 400 of FIG. 5 for further clarity of the torque thrust actuator 405.

In operation, the actuator 210 (shown in FIGS. 2 and 3) is activated which rotates the second sprocket 225. The second sprocket 225 rotates a lead screw 520 about an axis 530 which rotates within a sleeve 525. The axis 530 may be normal to the axis 515 of the gripper assembly 200. The lead screw 520 also rotates relative to a thrust nut 535. The relative rotation of the lead screw 520 and the thrust nut 535 thrusts the sleeve 525 that causes the gripper jaws 215 to move toward each other and contact an outer surface 540 of a tubular 545 (shown in phantom). The actuator 210 applies a low-torque to the lead screw 520 such that the gripper jaws 215 engage and contact the outer surface 540 of the tubular 545 but do not provide a grip sufficient to support the tubular 545.

The actuator 210 closes the gripper jaws 215 against the outer surface 540 of the tubular 545. The torque thrust actuators 405 provide the gripper jaws 215 with a gripping force sufficient to support and lift the tubular 545. The actuator 210 provides a first torque-to-thrust value to the gripper jaws 215 and the torque thrust actuators 405 provide a second torque-to-thrust value to the gripper jaws 215 such that the second torque-to-thrust value is greater than the first torque value.

Figure 6:
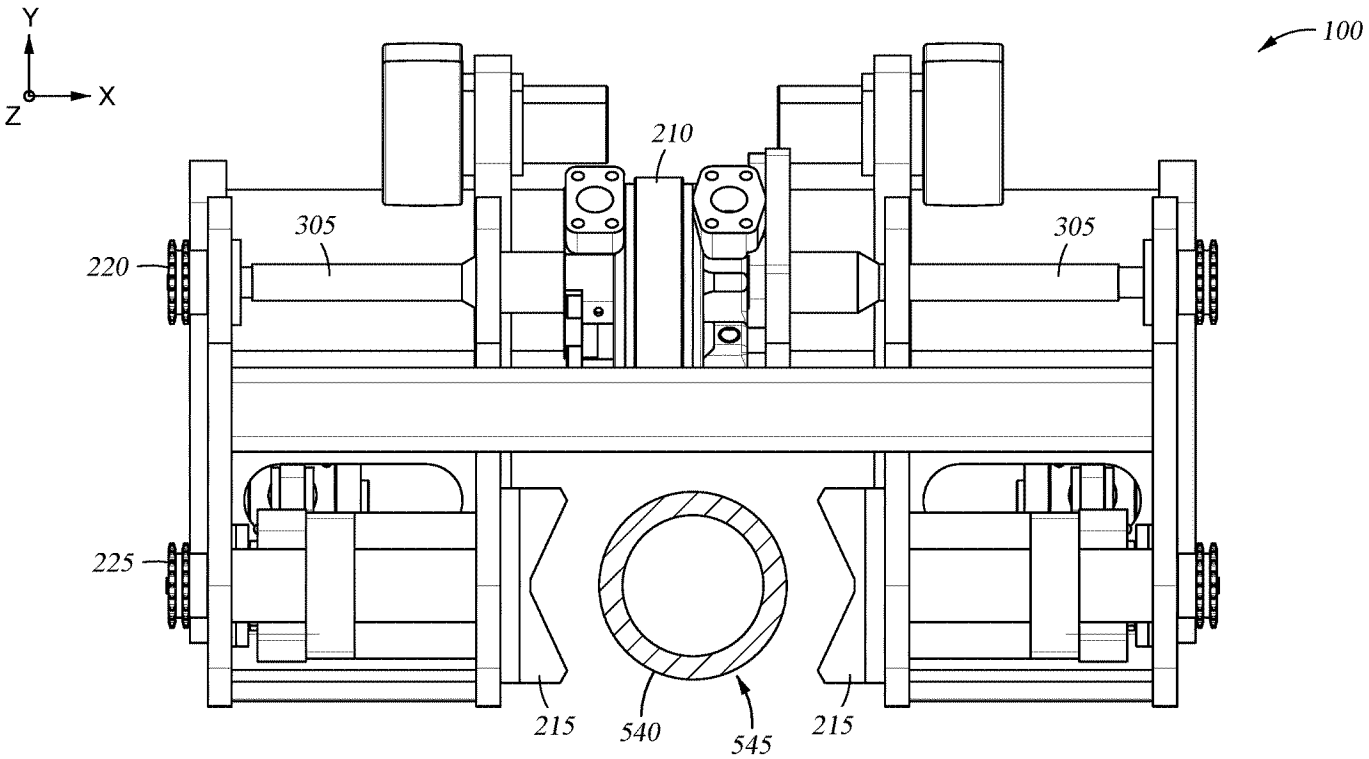
FIG. 6 is a top view of the clamp mechanism in a first position, not engaging a tubular.
Figure 7:
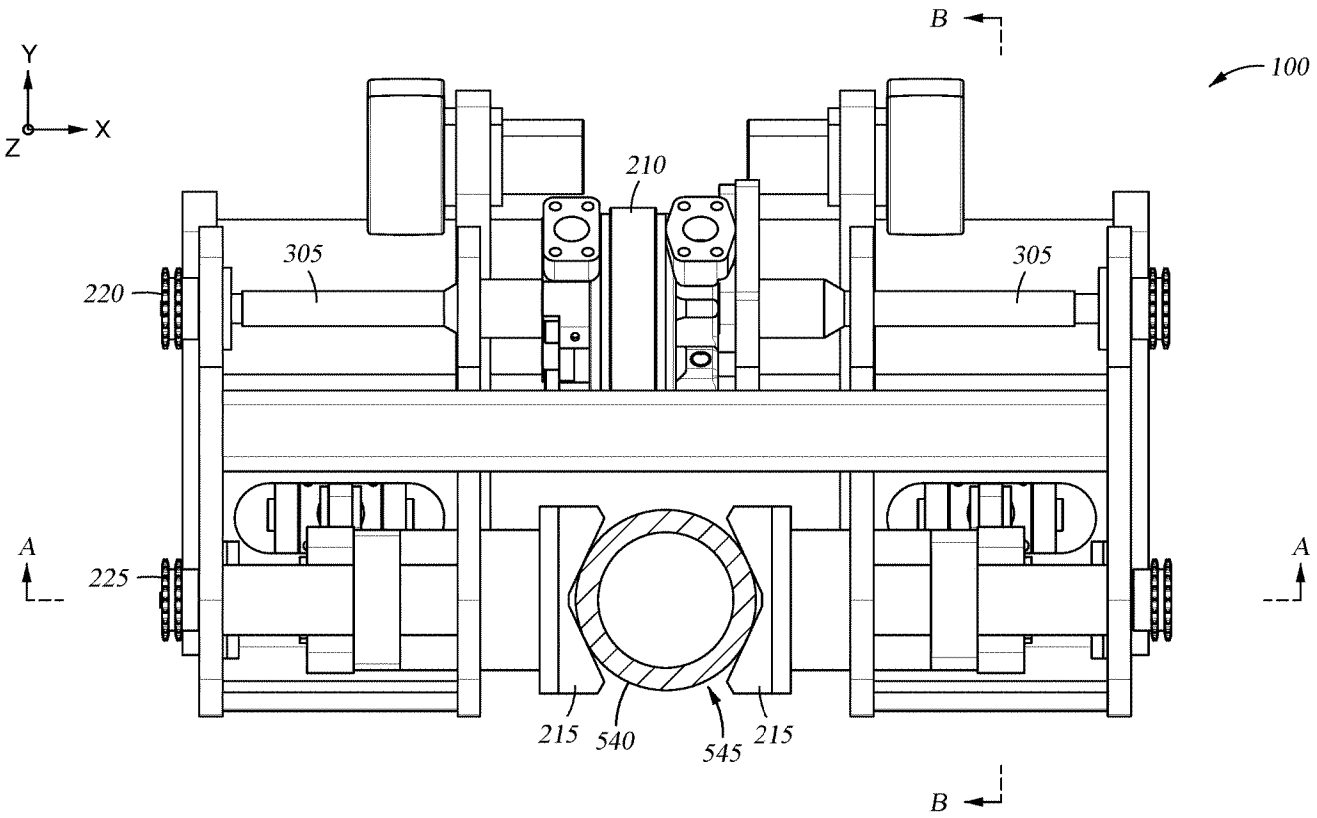
FIG. 7 is a top view of the clamp mechanism in a second position, engaging the tubular.

FIGS. 6 and 7 are top views of the clamp mechanism 100 showing the clamp mechanism 100 in a first, unclamped position and a second, clamped position engaging the tubular 545, respectively.

In FIG. 7, the gripper jaws 215 are engaged with the tubular 545 by the actuator 210 that moves the gripper jaws 215 toward each other. The low torque of the actuator 210 does not provide a sufficient gripping force to the gripper jaws 215 to support the tubular 545 but does bring the gripper jaws 215 into contact with the tubular 545 of any given diameter. The tubular 545 is not effectively gripped by the gripper jaws 215 based solely on the activation of the actuator 210.

Figure 8B:
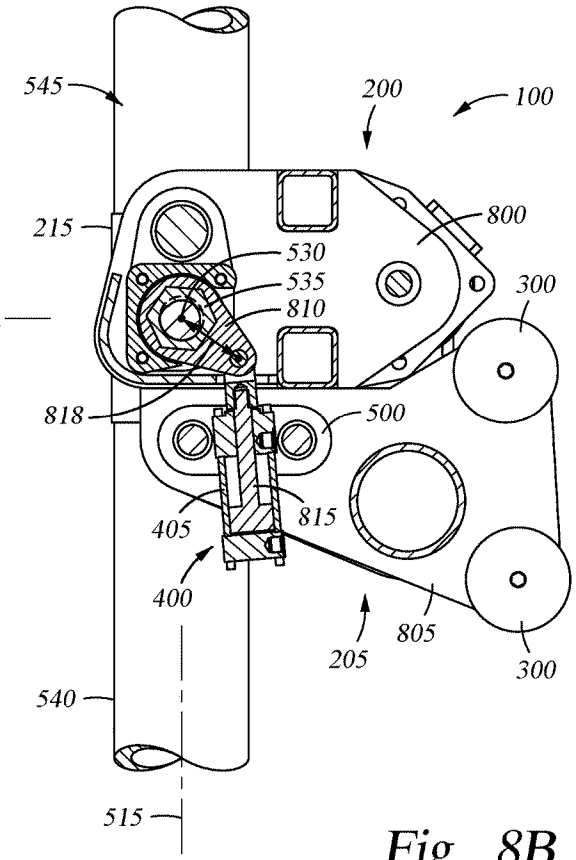
FIG. 8B is a sectional side view of the clamp mechanism of FIG. 8A.
Figure 8A:
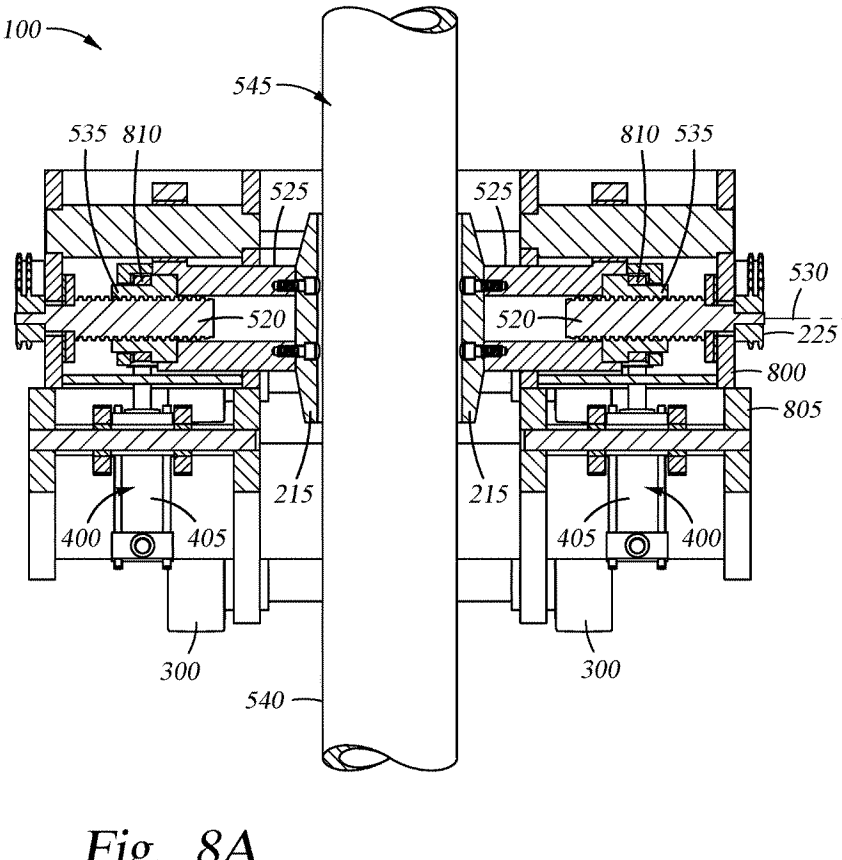
FIG. 8A is a sectional front view of the clamp mechanism engaging but not gripping the tubular.
Figure 9B:
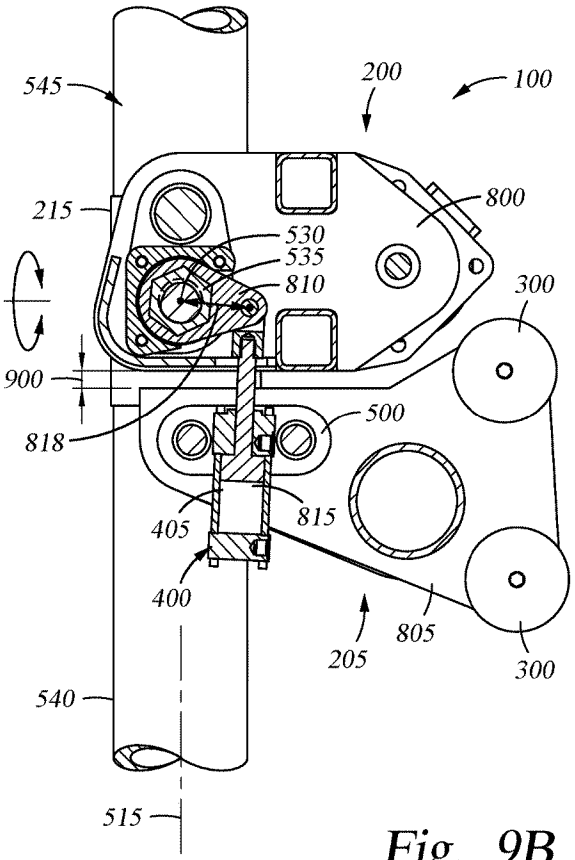
FIG. 9B is a sectional side view of the clamp mechanism of FIG. 9A.
Figure 9A:
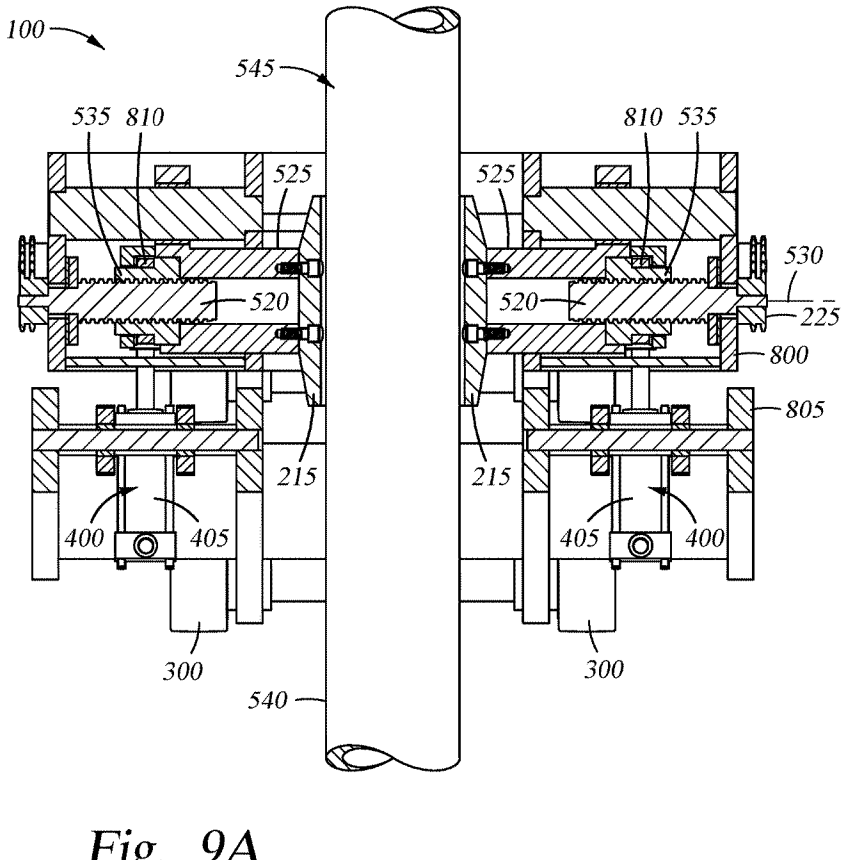
FIG. 9A is a sectional front view of the clamp mechanism engaging and gripping the tubular.
Figure 10B:
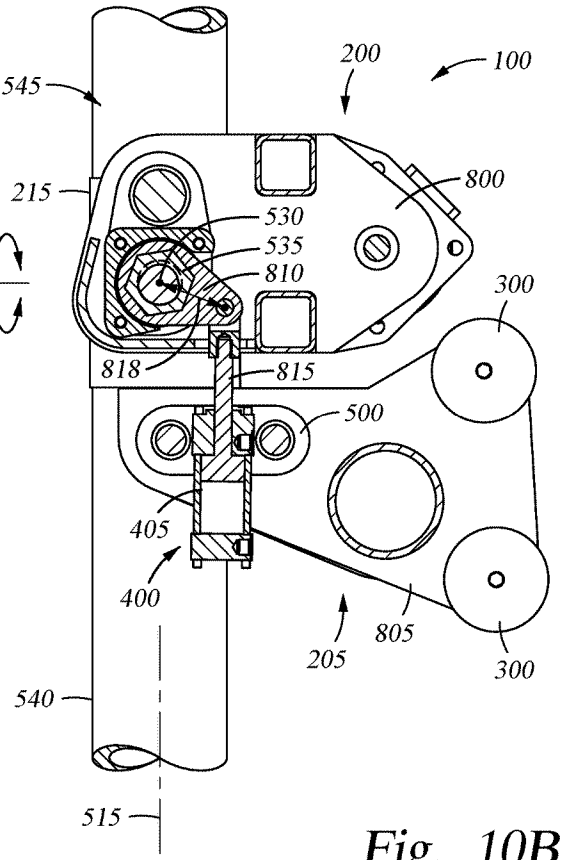
FIG. 10B is a sectional side view of the clamp mechanism of FIG. 10A.
Figure 10A:
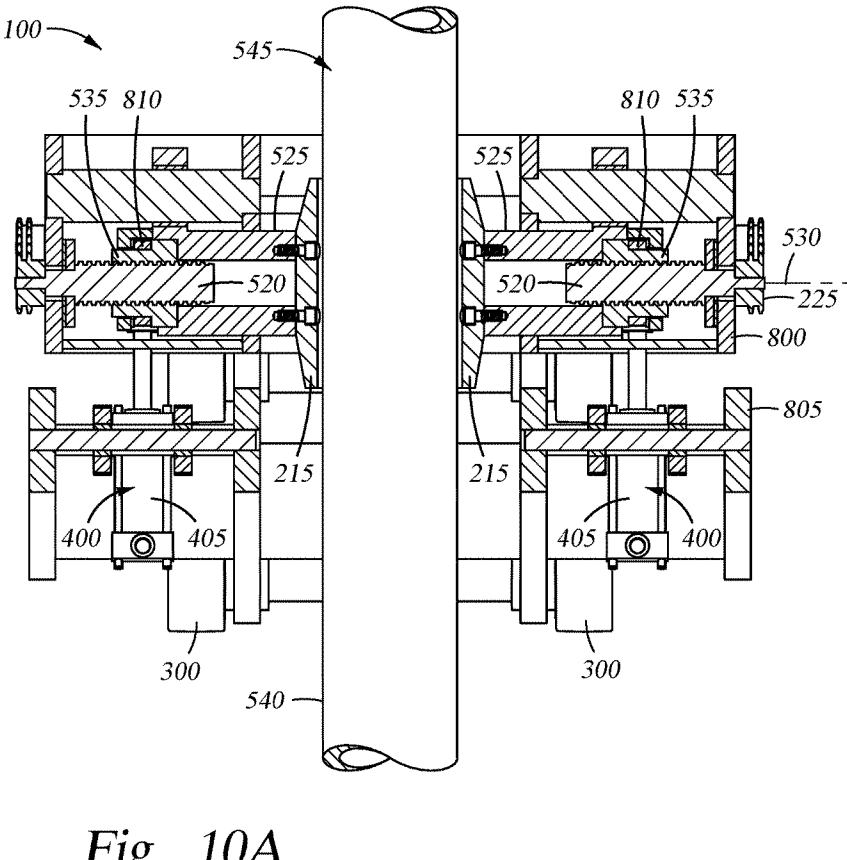
FIG. 10A is a sectional front view of the clamp mechanism engaging but not gripping the tubular due to a pull or push of the tubular up through the clamp mechanism.

FIGS. 8A and 8B are cross-sectional views of the clamp mechanism 100 engaged but not gripping the tubular 545. FIGS. 9A and 9B are cross-sectional views of the clamp mechanism 100 engaged and gripping the tubular 545. FIGS. 10A and 10B are cross-sectional views of the clamp mechanism 100 engaged but not gripping the tubular 545 due to the tubular 545 being pushed or pulled through the clamp mechanism 100.

FIGS. 8A, 9A, and 10A are sectional front views of the clamp mechanism 100 in different operating positions taken along line A-A of FIG. 7. FIGS. 8B, 9B, and 10B are sectional side views of the clamp mechanism 100 in different operating positions taken along line B-B of FIG. 7.

In FIGS. 8A and 8B, the gripper jaws 215 are engaged with the outer surface 540 of the tubular 545 utilizing only the actuator 210. As shown in FIGS. 8A and 8B, a support plate 800 of the gripper assembly 200 (e.g. upper support plate) is disposed on a support plate 805 of the carriage assembly 205 (e.g. lower support plate). A wrench plate 810, which may be part of the torque thrust assembly 400, is coupled between the thrust nut 535 and the arm 815 of the torque thrust actuator 405. The wrench plate 810 may include a tool interface that interfaces with an outer surface of the thrust nut 535 (e.g. a hex shape). In this position, the arm 815 is retracted into the torque thrust actuator.

The arm 815 is coupled to the wrench plate 810 at a point that is offset from the axis 530 of the lead screw 520 by a distance 818. When actuated, the arm 815 of the torque thrust actuators 405 applies a force to the wrench plate 810 at the offset distance 818 about the axis 530 which primarily acts to lift the weight of the tubular 545 as further described with respect to FIGS. 9A and 9B.

In FIGS. 9A and 9B, the gripper jaws 215 are engaging and gripping the outer surface 540 of the tubular 545 utilizing only the torque thrust actuators 405 with a sufficient force to grip and lift the tubular 545. Once the gripper assembly 200 has gripped and lifted the tubular 545 off the carriage assembly 205, the entire clamp mechanism 100 can be raised or lowered by the boom structure 105 along the length 110 of the beams 115 (shown in FIG. 1) to raise or lower the tubular 545. The weight of the tubular 545 loads the clamp mechanism 100 to maintain the grip by the gripper assembly 200.

The torque thrust actuator 405 is actuated (e.g. pressurized by a pressurized fluid) to extend the arm 815, which torques the thrust nut 535 via the wrench plate 810 against the lead screw 520 and forces the gripper jaws 215 via the sleeve 525 further into engagement against the outer surface 540 of the tubular 545 to grip the tubular 545. The arm 815 of the torque thrust actuators 405 applies a force to the wrench plate 810 at the distance 818 offset from the axis 530 such that the weight of the tubular 545 is proportional to the force that torques the thrust nut 535 and thrusts the gripper jaws 215 against the engaged tubular 545. This results in a torque-to-thrust mechanical advantage that "lifts" the gripped tubular 545 and the gripper assembly 200 off of the carriage assembly 205, signaling a positive grip on the tubular 545 where the grip force is a direct function of the weight of the tubular 545.

The gripper assembly 200 provides a constant proportional grip force relative to the weight of the tubular 545, which is equal to a constant coefficient of friction that can be controlled by the geometry of the lead screw 520 and the length of the wrench plate 810 connected to the arm 815 of the torque thrust actuator 405. The gripper assembly 200 will always grip just enough to lift the tubular 545, no more no less, based on a predetermined friction constant.

In the lifted position, the support plate 800 of the gripper assembly 200 is lifted up from the support plate 805 of the carriage assembly 205 by a distance 900 allowing for the live load of the tubular 545 to be fully supported through the wrench plate 810 and the torque thrust actuator 405 of the carriage assembly 205. As shown in FIG. 9B, the arm 815 of the torque thrust actuator 405 is extended from the position shown in FIG. 8B.

In FIGS. 10A and 10B, the gripper jaws 215 are engaging but not gripping the outer surface 540 of the tubular 545 as the gripper assembly 200 is raised enough off the carriage assembly 205 so that the torque thrust actuator 405 coupled to the wrench plate 810 is not supporting enough live load sufficient to grip and support the tubular 545.

In the event of the tubular 545 being pulled through the gripper jaws 215 by some external lifting apparatus, as would be the case in a hand-off operation or the pushing of the tubular 545 onto a drill floor, the gripper jaws 215 and gripper assembly 200 would be raised further off of the carriage assembly 205, which moves the wrench plate 810 down relative to the gripper assembly 200 reversing the wrench plate 810 torque about the axis 530. Since the arm 815 remains fully extended and coupled to the wrench plate 810, then as the wrench plate 810 is pulled away, the arm 815 will pull down on the wrench plate 810 and cause it to rotate the thrust nut 535 in the opposite direction to back out the lead screw 520 and the gripper jaws 215 to release the grip on the tubular 545. This acts as a fail-safe mechanism so that the tubular 545 can be pulled or pushed up through the gripper jaws 215 and automatically released from the gripper assembly 200 without causing damage to any of the equipment involved. The gripper jaws 215 however can remain engaged on the tubular 545 with just enough force to keep the tubular 545 captured and prevent it from toppling over.

The clamp mechanism 100 as described herein provides a gripper assembly 200 that can clamp a wide size range of tubulars, and lift and transfer the tubulars to other tubular handling equipment. The clamp force is a function of the tubular weight, which provides a suitable amount of grip force without crushing lighter/thinner walled tubulars or under clamping heavier/thicker walled tubulars. The gripper assembly 200 will not drop or lose grip on the tubular upon loss of power to the clamp mechanism 100.

While the foregoing is directed to embodiments of the disclosure, other and further embodiments of the disclosure thus may be devised without departing from the basic scope thereof, and the scope thereof is determined by the claims that follow.

The invention claimed is:

1. A tubular clamp system, comprising;

a boom structure; and a clamp mechanism coupled to the boom structure and configured to move a tubular relative to the boom structure, wherein the clamp mechanism comprises:

a carriage assembly movably coupled along a length of the boom structure to raise or lower the tubular; and a gripper assembly coupled to the carriage assembly, wherein the gripper assembly includes a pair of jaws movable into engagement with a tubular by a lead screw that is rotatable by a first actuator, and wherein the pair of jaws are configured to grip and lift the tubular by a thrust nut that is coupled to the lead screw and is rotatable by a second actuator.

2. The system of claim 1, wherein the first actuator is a low torque actuator.

3. The system of claim 2, wherein the second actuator is a torque thrust actuator having an arm coupled to the thrust nut by a wrench plate.

4. The system of claim 3, wherein the arm is extendable from the torque thrust actuator to rotate the wrench plate which rotates the thrust nut against the lead screw to force the pair of jaws to grip and lift the tubular.

5. The system of claim 4, wherein the gripper assembly is coupled to the carriage assembly by the torque thrust actuator and is raised off of the carriage assembly when the tubular is lifted.

6. The system of claim 5, wherein a clamp force applied to the tubular by the gripper assembly is proportional to the weight of the tubular.

7. The system of claim 6, wherein the gripper assembly is configured to automatically release the grip on the tubular when the tubular is pulled or pushed up through the gripper assembly.

8. The system of claim 7, wherein the clamp mechanism is movable along the boom structure to raise and lower the tubular gripped by the gripper assembly.

9. The system of claim 8, wherein the lead screw is disposed through the thrust nut.

10. The system of claim 9, wherein the torque thrust actuator applies a force to the wrench plate via the arm at a distance that is offset from a center axis of the lead screw.

11. A clamp mechanism for moving a tubular relative to a boom structure, comprising;

a carriage assembly movably coupled along a length of the boom structure to raise or lower the tubular; and a gripper assembly coupled to the carriage assembly, wherein the gripper assembly includes a pair of jaws movable into engagement with a tubular by a first actuator, and wherein the pair of jaws are configured to grip and lift the tubular by a second actuator.

12. The mechanism of claim 11, wherein the pair of jaws are movable into engagement with the tubular by a lead screw that is rotatable by the first actuator.

13. The mechanism of claim 12, wherein the pair of jaws are configured to grip and lift the tubular by a thrust nut that is coupled to the lead screw and is rotatable by a second actuator.

14. The mechanism of claim 13, wherein the second actuator is a torque thrust actuator having an arm coupled to the thrust nut by a wrench plate.

15. The mechanism of claim 14, wherein the arm is extendable from the torque thrust actuator to rotate the wrench plate which rotates the thrust nut against the lead screw to force the pair of jaws to grip and lift the tubular.

16. The mechanism of claim 15, wherein the gripper assembly is coupled to the carriage assembly by the torque thrust actuator and is raised off of the carriage assembly when the tubular is lifted.

17. The mechanism of claim 16, wherein the lead screw is disposed through the thrust nut.

18. The mechanism of claim 17, wherein the torque thrust actuator applies a force to the wrench plate via the arm at a distance that is offset from a center axis of the lead screw.

19. The mechanism of claim 11, wherein a clamp force applied to the tubular by the gripper assembly is proportional to the weight of the tubular.

20. The mechanism of claim 11, wherein the gripper assembly is configured to automatically release the grip on the tubular when the tubular is pulled or pushed up through the gripper assembly.

21. A tubular clamp system, comprising;

a boom structure; and a clamp mechanism coupled to the boom structure and configured to move a tubular relative to the boom structure, wherein the clamp mechanism comprises:

a carriage assembly movably coupled along a length of the boom structure to raise or lower the tubular;

a gripper assembly comprising a pair of jaws and coupled to the carriage assembly;

a first actuator configured to rotate a lead screw with respect to a thrust nut to move the pair of jaws into engagement with the tubular; and a second actuator configured to rotate the thrust nut to grip and lift the tubular with the pair of jaws.

* * * * *